United States Patent [19]

Lucius et al.

[11] 4,343,085

[45] Aug. 10, 1982

[54] CONNECTOR ASSEMBLY FOR MASS TERMINATION

[75] Inventors: John E. Lucius, Etters; Leon T. Ritchie, Mechanicsburg, both of Pa.

[73] Assignee: AMP Incorporated, Harrisburg, Pa.

[21] Appl. No.: 179,375

[22] Filed: Aug. 18, 1980

Related U.S. Application Data

[62] Division of Ser. No. 53,150, Jun. 28, 1979, Pat. No. 4,243,288.

[51] Int. Cl.[3] ..... H01R 43/04

[52] U.S. Cl. ..... 29/866; 29/857; 29/861

[58] Field of Search ..... 29/866, 861, 857, 862; 339/97 R, 97 P, 99 R, 103 R, 103 M, 103 C, 192 R, 196 M, 217 S, 107, 208, 206 P

[56] References Cited

U.S. PATENT DOCUMENTS

| | | | |
|---|---|---|---|
| 3,363,224 | 1/1968 | Gluntz . | |
| 3,569,900 | 3/1971 | Uberbacker | 339/107 X |
| 3,705,378 | 12/1973 | Elkins | 339/208 X |
| 3,720,907 | 3/1973 | Asick | 339/217 S X |
| 3,744,009 | 7/1973 | Teagno et al. | 339/103 M X |
| 3,853,388 | 12/1974 | Heimbrock . | |
| 3,854,787 | 12/1974 | Snyder, Jr. | 339/103 R |
| 3,860,318 | 1/1975 | Reavis, Jr. et al. . | |
| 3,864,010 | 2/1975 | Wasserlein, Jr. | 339/97 R |
| 3,864,011 | 2/1975 | Huber . | |
| 3,909,935 | 10/1975 | Aldridge et al. | 29/866 |
| 3,966,293 | 6/1976 | Mathe et al. . | |
| 4,017,141 | 4/1977 | Bury et al. | 339/217 S |
| 4,046,450 | 9/1977 | Yurtin . | |
| 4,066,316 | 1/1978 | Rollings | 339/97 R |
| 4,074,929 | 2/1978 | Krider | 339/97 R |
| 4,076,364 | 2/1978 | Kuo | 339/208 X |
| 4,083,615 | 4/1978 | Volinskie . | |
| 4,095,870 | 6/1978 | Mathe . | |
| 4,108,527 | 8/1978 | Douty et al. | 339/206 P X |
| 4,160,573 | 7/1979 | Weisenburger . | |
| 4,220,390 | 9/1980 | Cobaugh | 339/97 R |

*Primary Examiner*—Francis S. Husar
*Assistant Examiner*—Carl J. Arbes
*Attorney, Agent, or Firm*—Russell J. Egan

[57] ABSTRACT

A method is disclosed for effecting mass insulation displacing termination of a plurality of conductors by a like plurality of terminals which have been pre-loaded into a housing. The housing has a plurality of terminal passageways therein opening onto a mating face and each passageway receives a terminal with a matable portion directed toward the mating face and an insulation displacing conductor engaging portion which lies in a rear portion of the passage having an opening to the side of the housing. The housing further includes a pair of hermaphroditic cover members which enclose the rear portion of the housing and also provide a strain relief function for the conductors when assembled on the housing.

3 Claims, 5 Drawing Figures

CONNECTOR ASSEMBLY FOR MASS TERMINATION

This is a division, of application Ser. No. 053,150, filed June 28, 1979, U.S. Pat. No. 4,243,288 issued Jan. 6, 1981.

BACKGROUND OF THE INVENTION

1. The Field Of The Invention

The present invention relates to a connector assembly and in particular to a housing pre-loaded with terminals having a mating first end and an insulation displacing second end capable of mass terminating conductors while mounted in the housing and a pair of hermaphroditic cover members assembled on the housing to enclose the terminals and provide strain relief for the conductors.

2. The Prior Art

There is a constant need to provide more efficient and cost productive methods of mass terminating multiple conductors in a single operation. It is not always sufficient to crimp individual terminals on individual conductors and then individually load the terminated conductors into respective cavities in a housing. Such an assembly method is somewhat enhanced when, through proper design of the terminal and the housing, it is possible to crimp a conductor onto a partially loaded terminal and then fully insert the terminal into the housing. However, such arrangements have inherent difficulties in that the forces required for effecting termination can be of sufficient magnitude that they would cause destruction of the housing. Further, when the terminal is loaded partially or completely into the housing, there is very little room with which to work in effecting termination of a conductor.

SUMMARY OF THE INVENTION

The present invention overcomes the difficulties of the prior art by providing a connector assembly which utilizes a housing having a plurality of terminals preloaded therein. The housing has a plurality of terminal passages opening onto a front mating face. Each passage has a rear portion opening on the side of the housing. A like plurality of terminals are provided, each mounted in a respective passage with a mating portion directed toward the mating face and at least one insulation displacing slot exposed by the rear portion of the passage for terminating a respective conductor. A pair of hermaphroditic cover members engage the housing and enclose rear portion thereof while providing a conductor gathering and strain relief function.

It is therefore an object of the present invention to produce an improved electrical connector assembly which will provide cost efficient mass termination of multiple conductors in a single operation.

It is another object of the present invention to provide an improved electrical connector assembly utilizing preloaded and partially exposed insulation displacing terminals with hermaphroditic covers enclosing the terminals after termination.

It is a further object of the present invention to produce a connector assembly which is fully serviceable in that damaged terminals can readily be replaced by like insulation displacing terminals, crimped on terminals or the like.

It is a further object of the present invention to produce an improved electrical connector which can be readily and economically produced.

The means for accomplishing the foregoing objects and other advantages of the present invention will become apparent to those skilled in the art from the following detailed description taken with reference to the accompanying drawings.

DETAILED DESCRIPTION OF THE PREFERRED EMBODIMENT

Figure 1:
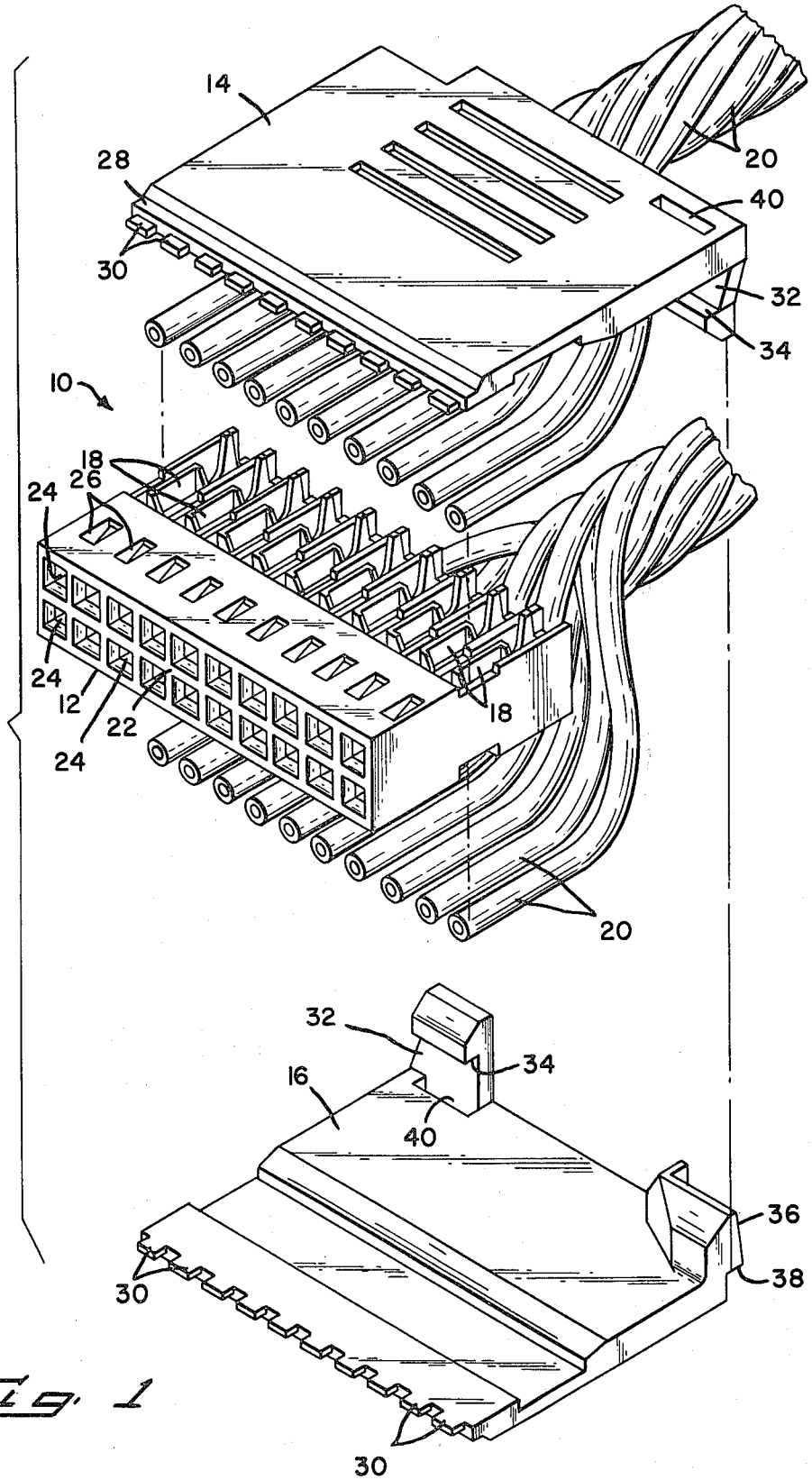
FIG. 1 is an exploded perspective view of the subject electrical connector assembly.
Figure 2:
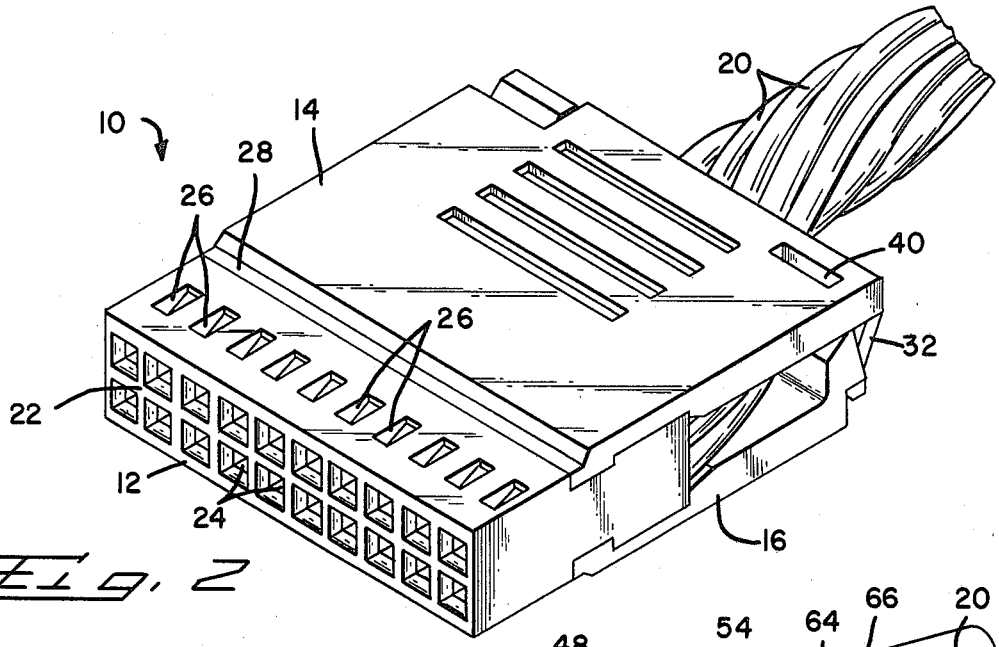
FIG. 2 is a perspective view of the subject electrical connector assembly in a fully assembled condition.
Figure 3:
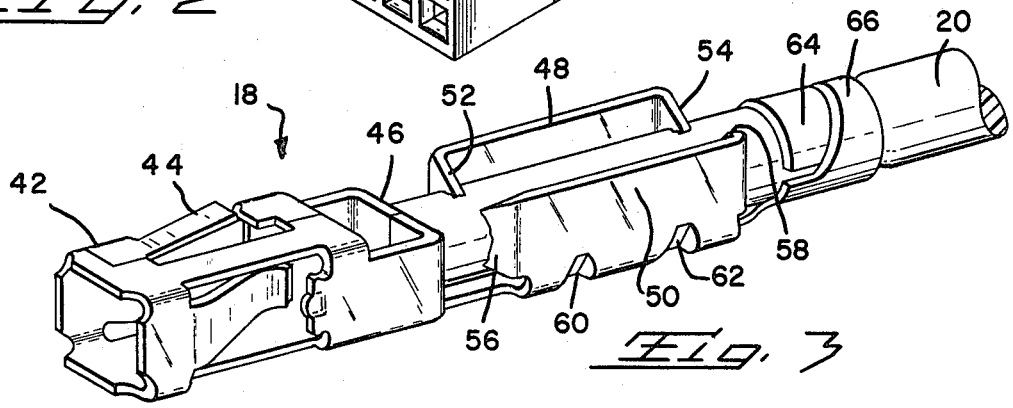
FIG. 3 is a perspective view of a terminal according to the present invention terminating an appropriate conductor.
Figure 4:
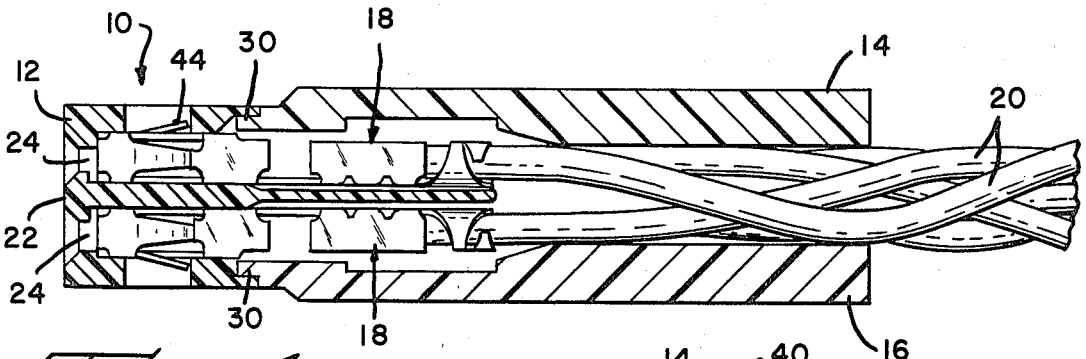
FIG. 4 is a longitudinal section through the assembled connector of FIG. 2.
Figure 5:
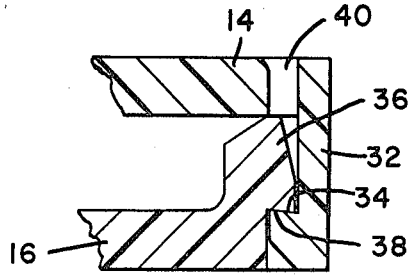
FIG. 5 is a detail view showing in transverse section the latching means of the cover members.

The subject connector assembly 10 includes a housing member 12, a pair of mating hermaphroditic cover members 14, 16 and a plurality of terminals 18 mounted in the housing 12 for terminating the respective conductors 20. The housing 12 is an elongated member of rigid plastics material having a mating face 22 with a plurality of terminal passages 24 opening therein in a pair of aligned rows. The sides of the housing are open at the rear so that the passages 24 are enclosed at their forward ends and are channel shaped opening outwardly at their rearward ends. The housing is also provided with a plurality of apertures 26 each aligned with a respective passage and spaced rearwardly of the mating face 22.

Each hermaphroditic cover member 14, 16 has a housing engaging edge portion 28 including a plurality of tines 30 each aligned to be received within a respective passage 24. The cover further includes, at one rear corner, a depending latching leg 32 having a shoulder 34 directed toward the housing engaging edge portion 28 and, on the opposite rear corner, an upwardly extending portion 36 defining a rearwardly directed shoulder 38. A slot 40 is formed in the cover immediately in front of a portion of the latching leg 32.

Each terminal 18 includes a forward mating end 42 which is here shown as a pin receptacle as the type described in U.S. Pat. No. 3,363,224, the disclosure of which is incorporated herein by reference. This receptacle portion includes an outwardly directed blocking lance 44 and a rear closure or post stop 46 which serves both to limit penetration of a mating pin terminal into the receptacle as well as penetration of the conductor 20 into the receptacle. The terminal 18 further includes an insulation displacing rear portion formed by a pair of upstanding walls 48, 50 defining a channel therebetween. Each end of each wall has an inwardly directed end portion 52, 54, 56, 58 with the opposing pairs of end portions defining insulation piercing slots therebetween. Each sidewall is provided with indents 60, 62 which provide strength to the sidewalls during the terminating operation. The terminal is completed by a pair of conductor engaging ears 64, 66.

The subject housing 12 is pre-loaded with a plurality of the terminals 18. Each terminal has its forward mating end 42 extending into a respective passage 24 with the latch 44 extending into an aperture 26 to secure the terminal in position. This leaves the channel shaped rear portion of the terminal in the exposed area of each passage. Each conductor can be layed into an appropriate passageway and terminated by a low force applied to the conductor to drive it into the slots defined by the inturned end portions 52, 54, 56, 58. This action will effect insulation piercing of the conductor to make a mechanical and electrical engagement therewith. This terminal action is accompanied by application of a die or like tool to the crimp ears 64, 66 to crimp them around the conductor to secure it in place. This crimping force is far less than what would be necessary to effect a normal F crimp or the like.

The terminated conductors are then gathered together, preferably by a simple twisting of the housing about the axis of the conductors. The cover members 14, 16 are then applied to opposite sides of the housing. Since the cover members are hermaphroditic, there is no problem in pairing or aligning them for closure. The assembly is completed merely by snapping the cover members together.

The present invention may be subject to many modifications and changes without departing from the spirit or essential characteristics thereof. The present embodiment should therefore be considered in all respects as illustrative and not restrictive of the scope of the invention.

What is claimed is:

1. A method of mass terminating a plurality of conductors comprising the steps of:

providing a housing with a plurality of parallel spaced terminal passages opening at a front end on a mating face and at a rear end on the side of the housing in the form of outwardly directed channels;

pre-loading a terminal in each said passageway with each said terminal having a forward mating portion directed towards said mating face and a rear conductor terminating portion including at least one outwardly directed insulation displacing slot and a pair of crimp ears disposed in said channel;

aligning said conductors with their axes parallel to those of said terminals;

applying conductors in a direction normal to said axes to engage each respective terminal to effect an insulation displacing termination thereof while substantially simultaneously crimping said crimp ears against said conductor; and enclosing the exposed rear side portion of each terminal and the rear end of said housing with a pair of hermaphroditic cover members by inserting one end portion of each said cover members into said passageways of said housing and rotating said cover members until their opposite ends are interengaging.

2. A method of effecting mass termination of a plurality of conductors in an electrical connector comprising the steps of:

providing a housing with a plurality of parallel spaced terminal passageways extending from a rear end through said housing to open on a front mating face, each said passageway being fully enclosed at the mating face end and outwardly directed open channel shaped at the rear end remote from said mating face;

preloading a like plurality of terminals each into a respective one of said passageways, each said terminal having a forwardly directed mating portion lying in said fully enclosed portion of said passageway and a pair of crimp ears and an insulation displation rear portion lying in and accessible from said rear channel shaped portion;

aligning a like plurality of conductors with their axes parallel to and spaced from respective ones of said terminals;

driving said conductors normal to their axes to terminate in the insulation displacing rear portions of respective terminals;

crimping said ears to engage a respective conductor to provide strain relief therefor; and applying to said housing a pair of hermaphroditic cover members by inserting a forward end of each cover member into said enclosed portions of said passageways and rotating said cover members relative to each other to engage intermating rear latching portions, said cover members surrounding and enclosing said terminals.

3. A method according to claim 2 wherein:

said termination and crimping are substantially simultaneous.

* * * * *